US005501429A

United States Patent [19]

Sakuma

[11] Patent Number: 5,501,429

[45] Date of Patent: Mar. 26, 1996

[54] PARTITION POLE SYSTEM

[75] Inventor: Shusuke Sakuma, Tokyo, Japan

[73] Assignee: Kabushiki Kaisha Shukoh, Tokyo, Japan

[21] Appl. No.: 251,957

[22] Filed: Jun. 1, 1994

[51] Int. Cl.[6] ..... E04H 17/00

[52] U.S. Cl. ..... 256/1; 256/45; 49/34

[58] Field of Search ..... 256/1, 45; 211/119.15, 211/119.1; 160/24; 49/34; 404/6, 7, 10

[56] References Cited

U.S. PATENT DOCUMENTS

| | | | |
|---|---|---|---|
| 2,315,516 | 4/1943 | Gray | 256/1 |
| 2,904,189 | 9/1959 | Eisert | 211/119.1 |
| 3,917,231 | 11/1975 | Fink | 256/1 X |
| 4,124,196 | 11/1978 | Hipskind | 256/1 |
| 4,533,122 | 8/1985 | Bannister | 256/1 X |
| 4,844,420 | 7/1989 | Oster . | |

FOREIGN PATENT DOCUMENTS

| | | | |
|---|---|---|---|
| 0287510 | 10/1988 | European Pat. Off. . | |
| 0375580 | 6/1990 | European Pat. Off. . | |
| 9111337 | 3/1992 | Germany . | |
| 672772 | 10/1964 | Italy | 49/34 |
| 5163709 | 6/1993 | Japan | 49/34 |
| 2262120 | 6/1993 | United Kingdom . | |

OTHER PUBLICATIONS

Patent Abstracts of Japan, vol. 17, No. 569 (M-1496) 15 Oct. 1993, & JP-A-05 163 709 (Shiyuukou) 29 Jun. 1993.

Patent Abstracts of Japan, vol. 17, No. 370 (M-1444) 13 Jul. 1993, & JP-A-05 059 708 (Yasushi Mimaki) 9 Mar. 1993.

*Primary Examiner*—Kenneth J. Dorner
*Assistant Examiner*—Harry C. Kim
*Attorney, Agent, or Firm*—Birch, Stewart, Kolasch & Birch

[57] ABSTRACT

A partition pole system for guiding visitors in public spaces, buildings, or the like has a plurality of spaced partition poles each composed of a base and a hollow pole mounted on the base, and a plurality of partition cords housed in the poles, respectively, for withdrawal therefrom through respective withdrawal holes thereof. A connector is mounted on a distal end of each of the partition cords for connection to the coupling of another pole. Each of the poles houses a vertically movable weight for pulling each of the partition poles into one of the poles, and a releasable stopper for keeping each of the partition cords withdrawn out of one of the poles. The poles may be vertically mounted on the respective bases or inclined with respect to the respective bases.

8 Claims, 3 Drawing Sheets

PARTITION POLE SYSTEM

BACKGROUND OF THE INVENTION

1. Field of the Invention

The present invention relates to a partition pole system which can temporarily or stationarily be installed in any of various event spaces such as exhibitions, display areas, party spaces, and the like, or any of various buildings or rooms such as art museums, theaters, restaurants, and the like, and more particularly to a partition pole system with suspended partition cords for guiding or organizing visitors in various public spaces or areas.

2. Description of Background Art

Various event spaces, public buildings and rooms which many people are expected to visit are required to have some guides for organizing visitors to prevent them from being confused and also for guiding people without blocking their sight. One typical guiding structure for use in such environments is a partition pole system composed of a plurality of partition poles arranged along the path of visitors and a plurality of partition ropes suspended by and between the partition poles.

Heretofore, each of the partition poles comprises a disk-shaped base and a pole vertically mounted on the disk-shaped base and having a hook mounted on its upper end. Each of the partition ropes has one end suspended from the hook of one of the partition poles.

The conventional partition pole system has a problem because it is tedious and time-consuming to suspend and remove the partition ropes and laborious to store the removed partition ropes.

Furthermore, since the poles are mounted vertically on the respective disk-shaped bases, the visitors have difficulty in finding the direction to follow though they can recognize the positions of the partition poles. Consequently, it is necessary to have direction indicators installed in addition to the partition poles. If the space is crowded with many visitors, however, the visitors tend to miss such direction indicators.

SUMMARY OF THE INVENTION

It is therefore an object of the present invention to provide a partition pole system which allows partition cords to be quickly installed or removed without special manual efforts for thereby saving time and labor in setting up or clearing a visitor guidance arrangement in public spaces or areas, and which is effective in easily guiding visitors as intended.

According to the present invention, there is provided a partition pole system comprising a plurality of spaced partition poles each composed of a base and a hollow pole mounted on the base, the hollow pole having a withdrawal hole defined in an upper end portion thereof and a coupling disposed in the upper end portion, a plurality of partition cords housed in the poles, respectively, for withdrawal therefrom through the respective withdrawal holes thereof, a connector mounted on a distal end of each of the partition cords for connection to the coupling of another pole, drawing means for pulling each of the partition poles into one of the poles, and a releasable stopper for keeping each of the partition cords withdrawn out of one of the poles.

To install the partition pole system, the partition poles are positioned along a direction for guiding visitors. Then, the stoppers are released, and the partition cords are withdrawn from the poles through the respective withdrawal holes. When the partition cords are withdrawn from the poles to a desired length, the stoppers operate to keep the partition cords withdrawn. The connectors on the distal ends of the partition poles are joined to the couplings of adjacent poles. The partition pole system can thus be installed quickly without substantial manual efforts.

To disassemble the partition pole system, the connectors are disconnected from the couplings of the adjacent poles, and the stoppers are released. Then, the partition cords are automatically stored into the respective poles by the drawing means. Consequently, the partition cords can easily and quickly be removed and stored back into the poles.

Preferably, the stopper comprises an engaging bar angularly movably supported in each of the poles below the withdrawal hole by a pivot shaft and having an inner end engageable with an abutment on an inner wall surface of the pole when the end is lowered and releasable from the abutment when the end is lifted. The engaging bar has an outer end projecting out of the pole through a hole defined in a side wall thereof. Each of the partition cords extends from the withdrawal hole between the inner end of the engaging bar and the abutment of the pole, and includes an end connected to the engaging bar between the inner end thereof and the pivot shaft. The drawing means comprises a weight movably hung from the partition cord between the inner end of the engaging bar and the end of the partition cord. The partition cord is urged to be pulled into the pole under the load of the weight. The weight also causes the inner end of the engaging bar to press the partition cord against the abutment, so that the partition cord which is withdrawn is pinched so as to remain withdrawn. When the outer end of the partition cord is lowered, the inner end of the engaging bar is lifted away from the abutment, thereby releasing the partition cord.

The connector may have an insert removably insertable in an insertion hole defined in the upper end portion of the pole, the insert having a tooth removably disengageable in a cavity defined in the upper end portion of the pole and opening into the insertion hole. The insert with the tooth allows the partition cord to be suspended easily between two adjacent poles.

In the case where the partition poles are inclined with respect to the respective bases along a direction to guide visitors and the partition cords are suspended between the partition poles, the inclined partition poles jointly present a visual guide to allow the visitors to easily recognize the direction to follow. In the case where two poles are inclined toward each other with respect to the respective bases, the inclined partition poles also jointly present a visual guide to allow the visitors to easily recognize that the visitors are prohibited from proceeding beyond the partition poles.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
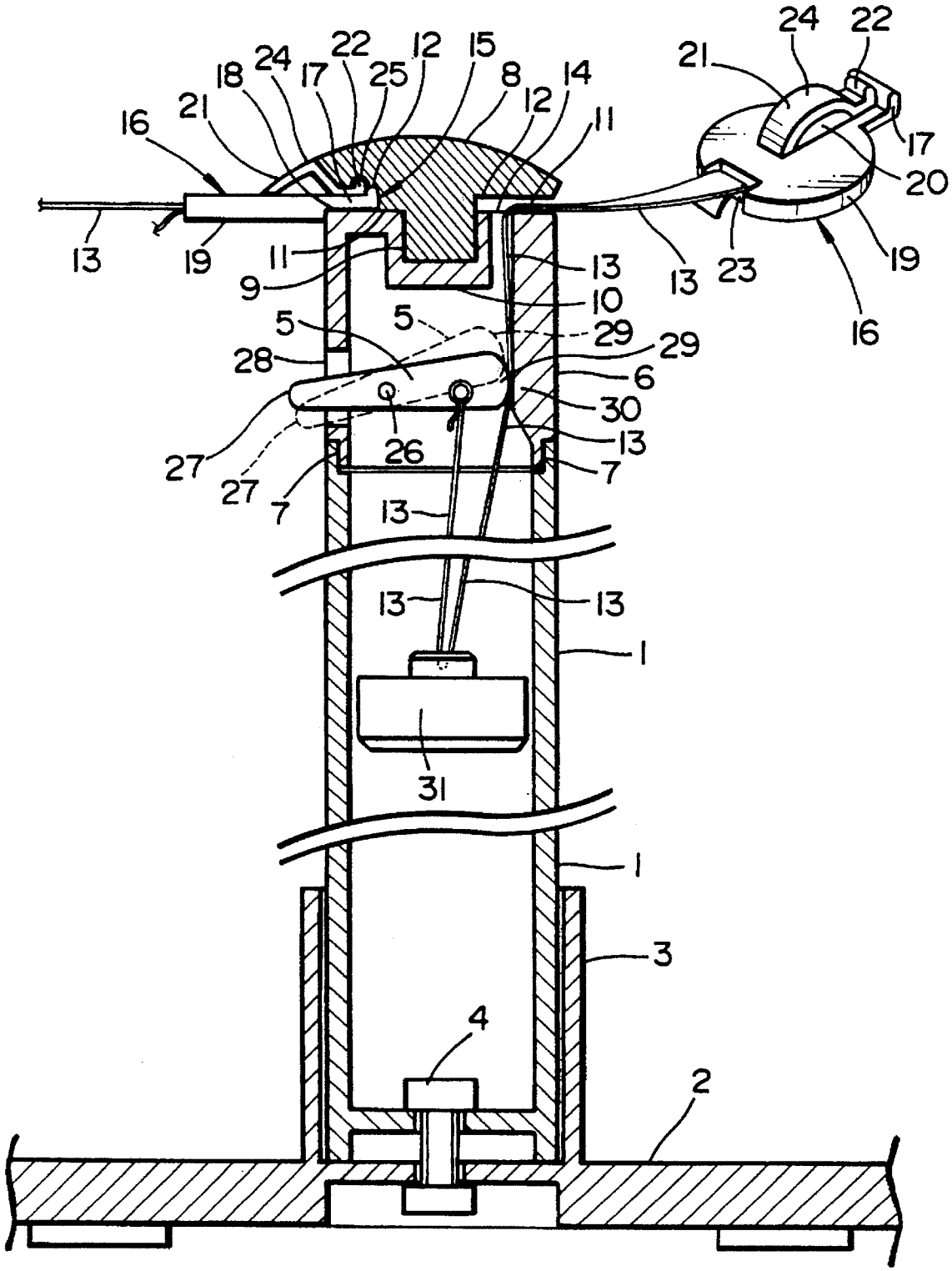
FIG. 1 is a fragmentary vertical cross-sectional view of a partition pole of a partition pole system according to an embodiment of the present invention.

As shown in FIG. 1, a partition pole system according to an embodiment of the present invention has a plurality of partition poles (only one shown) each composed of a hollow cylindrical pole 1 mounted vertically in a support sleeve 3 which extends vertically from and is integral with a flat base 2. The pole 1 is fastened at its bottom to the flat base 2 by a bolt 4. The partition pole also has a cylinder 6 mounted on the upper end of the pole 1 and housing an engaging bar 5 therein which serves as a partition cord stopper. The cylinder 6 has a joint 7 of reduced diameter on its lower end which is inserted in and secured to the upper end of the pole 1. The cylinder 6 also has a flat upper surface on its upper end which has a withdrawal hole 14 defined in a side edge portion thereof for allowing a partition cord 13 housed in the pole 1 to be withdrawn therethrough out of the pole 1. The flat upper surface 11 has an upwardly open recess 10 defined substantially centrally therein.

A cap 8 is mounted on the upper end of the cylinder 6. The cap 8 has a substantially central downward protrusion 9 on its lower surface 12 which is securely fitted in the recess 10 in the flat upper surface 11, thus fixing the cap 8 to the upper end of the cylinder 6. With the cap 8 thus fixed to the cylinder 6, the lower surface 12 of the cap 8 is spaced upwardly from the top plate 11 by the protrusion 9 engaged in the recess 10, providing a gap therebetween in communication with the withdrawal slot 14. The partition cord 13 stored in the pole 1 can be withdrawn out of the pole 1 through the withdrawal slot 14 and the gap between the lower surface 12 of the cap 8 and the flat upper surface 11 of the cylinder 6. A coupling 15 is provided in the gap between the lower surface 12 of the cap 8 and the flat upper surface 11 of the cylinder 6. A connector 16 is joined to the distal end of the partition cord 13 for connection to the coupling 15 on the cylinder 6 of another pole 1.

Figure 2:
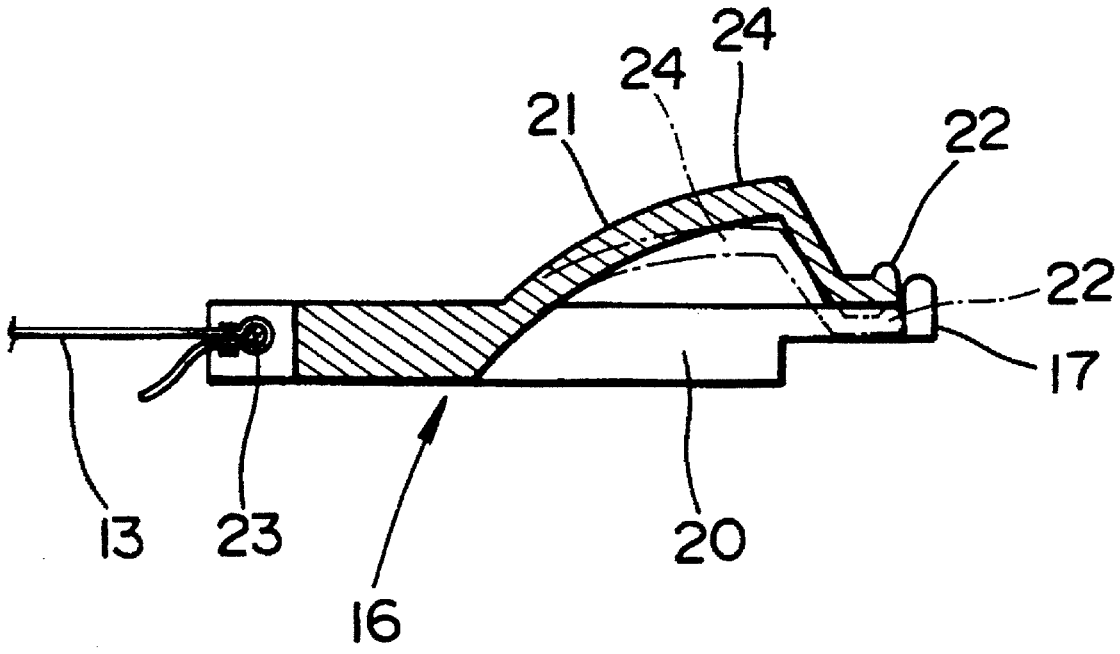
FIG. 2 is a cross-sectional view of a connector for use with the partition pole shown in FIG. 1.

The connector 15 has an insertion hole 18 defined therein which receives an insert 17 (described below) of the connector 16. As shown in FIGS. 1 and 2, the connector 16 comprises a disk-shaped body 19 and an insert 17 integral with the disk-shaped body 19 and extending radially outwardly therefrom for insertion into the insertion hole 18. The disk-shaped body 19 has a recess 20 defined therein which extends from a substantially central portion thereof toward the insert 17, and a tongue 21 including a curved portion 24 extending arcuately upwardly from a proximal end of the recess 20 and a bent portion extending linearly obliquely downwardly from the curved portion 24 and extending along the insert 17. The tongue 21 has a tooth 22 on its distal end which is positioned upwardly of the recess 20. The disk-shaped body 19 also has an attachment 23 positioned diametrically opposite to the insert 17 for connection to the distal end of the partition cord 13. The tongue 21 is resilient such that the arcuately curved portion 24 can be depressed by a finger or the like. In its free state, the tooth 22 projects upwardly out of the recess 20 as indicated by the solid lines in FIG. 2. When the arcuately curved portion 24 is pressed downwardly, the tongue 21 is flexed resiliently downwardly to cause the tooth 22 to project into the recess 20 as indicated by the imaginary lines in FIG. 2.

As shown in FIG. 1, a cavity 25 is defined in the lower surface 12 of the cap 8, which serves as an inner wall of the insertion hole 18, for fitting engagement with the tooth 22 of the tongue 21. The cavity 15 opens into the insertion hole 18. When the insert 17 of the connector 16 joined to the partition cord 13 which is withdrawn from an adjacent pole (not shown) is inserted into the insertion hole 18, the tooth 22 resiliently snaps into the cavity 25 and holds the connector 16 joined to the coupling 15, thereby keeping the partition cord 13 suspended between the two adjacent partition poles. When the curved portion 24 of the tongue 16 of the joined connector 16 is depressed, the tooth 22 is displaced downwardly out of the cavity 25 thereby to allow the partition cord 13 to be released from the partition pole.

As shown in FIG. 1, the engaging bar 5 is angularly movably supported in the cylinder 6 below the withdrawal hole 14 by a pivot shaft 26 which is attached to a substantially central portion of the engaging bar 5. The engaging bar 5 has an outer end 27 projecting out of the cylinder 6 through a hole 28 defined in a side wall of the cylinder 6. The cylinder 6 has an abutment 30 on an inner wall surface thereof which can be engaged by an inner end 29 of the engaging bar 5 when the engaging bar 5 is in a substantially horizontal position. The inner end 29 of the engaging bar 5 can be released from abutting engagement with the abutment 30 when the inner end 29 is angularly moved upwardly in the cylinder 6, i.e., when the outer end 27 is angularly moved downwardly outside the cylinder 6. The partition cord 13 in the partition pole extends downwardly from the withdrawal hole 14 and then between the inner end 29 of the engaging bar 5 and the abutment 30 of the cylinder 6, and has an end connected to the portion of the engaging bar 5 between the inner end 29 thereof and the pivot shaft 26.

Within the pole 1, there is disposed a weight 31 which is vertically movably hung from the portion of the partition cord 13 which extends between the inner end 29 of the engaging bar 5 and the end of the partition cord 13 which is joined to the engaging bar 5.

The partition cord 13 is normally urged to be pulled into the pole 1 by the load of the weight 31. At the same time, the inner end 29 of the engaging bar 5 is urged to press the partition cord 13 against the abutment 30 under the load of the weight 31. Accordingly, once the partition cord 13 is withdrawn out of the pole 1, it is frictionally pinched between the inner end 29 and the abutment 30 and remains drawn out of the pole 1.

For storing the partition cord 13 back into the pole 1, the outer end 27 of the engaging bar 5 which projects out of the cylinder 6 is pushed downwardly as indicated by the imaginary lines in FIG. 1. Now, the engaging bar 5 is turned counterclockwise in FIG. 1, lifting the inner end 29 out of pressing engagement with the partition cord 13. The weight 31 descends in the pole 1 due to gravity while pulling the partition cord 13 into the pole 1 until the partition cord 13 is stored in the pole 1. Therefore, the partition cord 13 can automatically be stored into the pole 1 simply by depressing the outer end 27 of the engaging bar 5.

For drawing the partition cord 13 out of the pole 1, the partition cord 13 is pulled out with a force greater than the load of the weight 31. As the partition cord 13 moves upwardly, the inner end 29 of the engaging bar 5 is also lifted, releasing the partition cord 13 out of pressed engagement with the abutment 30. Consequently, the partition cord 13 can easily be pulled out manually.

As described above, the partition cord 13 can be stored into and pulled out of the pole 1 with utmost ease, and can also be suspended on and removed from two adjacent partition poles simply by connecting the connector 15 to and disconnecting the connector 16 from the coupling 16 on the cylinder 6 of one of the two adjacent partition poles.

While the partition pole has the cylinder 6 with the engaging bar 5 disposed therein and the cap 8 in the illustrated embodiment, the cylinder 6 may be dispensed with, and the engaging bar 5, the coupling 15, the withdrawal hole 14, the abutment 30, and other components may be disposed in an upper end portion of the pole 1.

Figure 3:
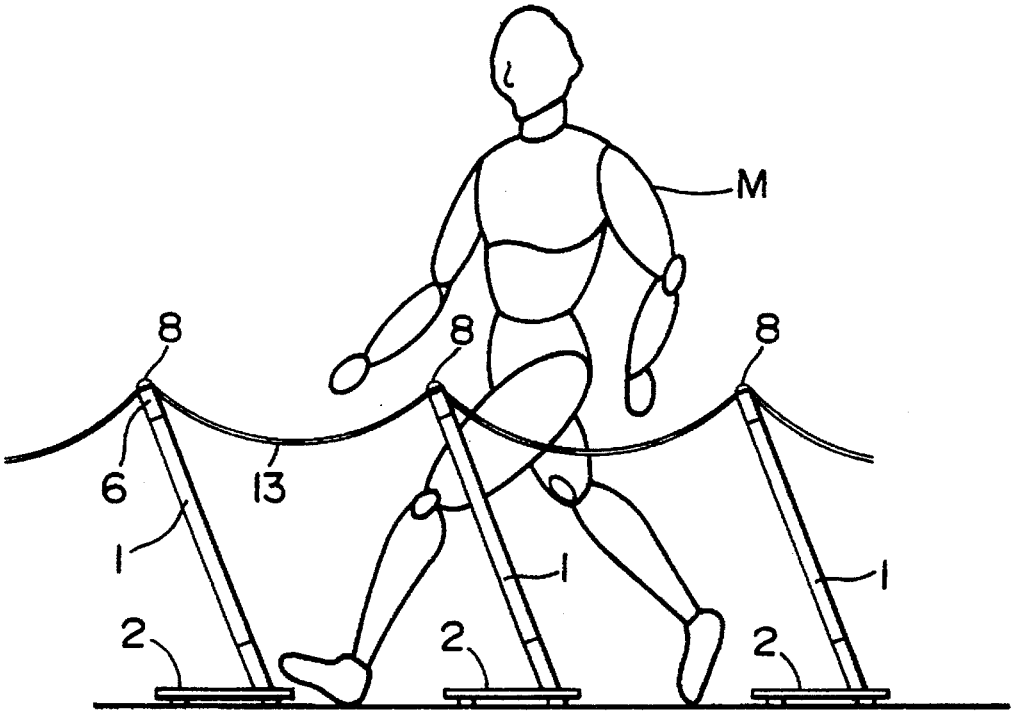
FIG. 3 is an elevational view of a partition pole system according to another embodiment of the present invention, the partition pole system being installed in one installation mode.
Figure 4:
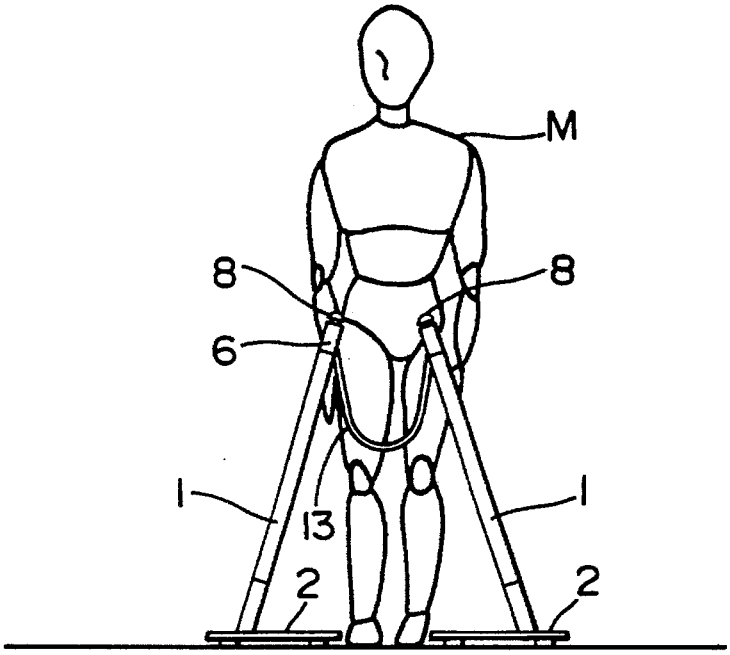
FIG. 4 is an elevational view of the partition pole system shown in FIG. 3, the partition pole system being installed in another installation mode.

In the illustrated embodiment, the pole 1 is vertically mounted on the base 2. However, the pole 1 may be obliquely mounted on the base 2 as shown in FIGS. 3 and 4. More specifically, in another embodiment shown in FIG. 3, a number of poles 1 are inclined with respect to respective bases 2 in a direction for guiding a visitor M, and partition cords 13 withdrawn from the respective poles 1 are suspended between the poles 1. The poles 1 inclined as shown in FIG. 3 allow the visitor M to easily recognize the direction to follow. In still another embodiment shown in FIG. 4, a pair of poles 1 is inclined toward each other with respect to respective bases 2, and a partition cord 13 withdrawn from one of the poles 1 is suspended between the poles 1. A visitor M standing in front of the poles 1 inclined as shown in FIG. 4 can easily recognize that he or she is not allowed to proceed past the poles 1.

Although a certain preferred embodiment of the present invention has been shown and described in detail, it should be understood that various changes and modifications may be made therein without departing from the scope of the appended claims.

What is claimed is:

1. A partition pole system comprising:

a plurality of spaced partition poles each composed of a base and a hollow pole mounted on said base, said hollow pole having a withdrawal hole defined in an upper end portion thereof and a coupling disposed in said upper end portion;

a plurality of partition cords housed in said poles, respectively, for withdrawal therefrom through the respective withdrawal holes thereof;

a connector mounted on a distal end of each of said partition cords for connection to the coupling of another pole;

drawing means for pulling each of said partition cords into each of said poles, respectively; and a releasable stopper for keeping each of said partition cords withdrawn out of each of said poles, respectively, and wherein said stopper comprises an engaging bar pivotally supported in each of said poles below said withdrawal hole and having an inner end engageable with an abutment defined on an inner wall surface of the pole when said inner end is lowered and releasable from said abutment when said inner end is lifted.

2. The partition pole system according to claim 1, wherein said stopper is pivotally supported by a pivot shaft, said engaging bar comprising an outer end projecting out of the pole through a hole defined in a side wall thereof, each of said partition cords extending from said withdrawal hole between said inner end of the engaging bar and said abutment of the pole, and having an end connected to said engaging bar between said inner end thereof and said pivot shaft.

3. The partition pole system according to claim 1, wherein said connector has an insert removably insertable in an insertion hole defined in the upper end portion of each of said respective poles, said insert having a tooth removably engageable in a cavity defined in the upper end portion of each of said poles and opening into said insertion hole.

4. The partition pole system according to claim 1, wherein said poles are inclined with respect to said bases, respectively.

5. The partition pole system according to claim 1, wherein said drawing means comprising a weight movably hung from the partition cord between said inner end of the engaging bar and said end of the partition cord.

6. A partition pole system comprising:

a plurality of spaced partition poles each including a base and a hollow pole mounted on said base, said hollow pole having a withdrawal hole defined in a distal end portion of said pole and a coupling disposed in said distal end portion;

a plurality of partition cords housed in said poles, respectively, for withdrawal therefrom through the respective withdrawal holes thereof;

a connector mounted on a distal end of each of said partition cords for connection to the coupling of another pole;

drawing means for pulling each of said partition cords into each of said poles, respectively; and a releasable stopper for keeping each of said partition cords withdrawn out of each of said poles, respectively, said stopper including an engaging bar pivotally movably supported in each of said poles, respectively, below said withdrawal hole by a pivot shaft and having an inner end engageable with an abutment on an inner wall surface of the pole when said inner end is lowered and releasable from said abutment when said inner end is lifted, said engaging bar having an outer end projecting out of the pole through a hole defined in a side wall thereof, each of said partition cords extending from said withdrawal hole between said inner end of the engaging bar and said abutment of the pole, and having an end connected to said engaging bar between said inner end thereof and said pivot shaft;

said drawing means includes a weight movably hung from the partition cord between said inner end of the engaging bar and said end of the partition cord.

7. The partition pole system according to claim 6, wherein said connector includes an insert removably insertable in an insertion hole defined in the distal end portion of the pole, said insert having a tooth removably disengageable in a cavity defined in the distal end portion of the pole and opening into said insertion hole.

8. The partition pole system according to claim 6, wherein said poles are inclined with respect to said bases, respectively.

* * * * *